US011971171B2

(12) United States Patent
Beck et al.

(10) Patent No.: US 11,971,171 B2
(45) Date of Patent: Apr. 30, 2024

(54) PILOT CONE COOLING

(71) Applicant: Siemens Energy Global GmbH & Co. KG, Bayern (DE)

(72) Inventors: Christian Beck, Essen (DE); Jürgen Meisl, Mülheim an der Ruhr (DE); Stefan Reich, Düsseldorf (DE); Sabrina Isolde Siebelist, Ratingen (DE); Christopher Grandt, Heiligenhaus (DE); Benjamin Witzel, Duisburg (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/923,588

(22) PCT Filed: Feb. 24, 2021

(86) PCT No.: PCT/EP2021/054508
§ 371 (c)(1),
(2) Date: Nov. 6, 2022

(87) PCT Pub. No.: WO2021/228447
PCT Pub. Date: Nov. 18, 2021

(65) Prior Publication Data

US 2023/0184437 A1 Jun. 15, 2023

(30) Foreign Application Priority Data

May 15, 2020 (EP) ..... 20174892

(51) Int. Cl.
*F23R 3/28* (2006.01)
*F23R 3/34* (2006.01)

(52) U.S. Cl.
CPC ..... *F23R 3/283* (2013.01); *F23R 3/343* (2013.01)

(58) Field of Classification Search
CPC .. F23R 3/28; F23R 3/283; F23R 3/286; F23R 3/343
See application file for complete search history.

(56) References Cited

U.S. PATENT DOCUMENTS 5,941,076 A 8/1999 Sandelis
6,282,905 B1 * 9/2001 Sato ..... F23R 3/002 60/757

(Continued)

FOREIGN PATENT DOCUMENTS

CN 106051825 A 10/2016
CN 109424981 A 3/2019

(Continued)

OTHER PUBLICATIONS

PCT International Search Report and Written Opinion of International Searching Authority dated Nov. 18, 2021 corresponding to PCT International Application No. PCT/EP2021 /054508 filed Feb. 24, 2021.

*Primary Examiner* — William H Rodriguez
(74) *Attorney, Agent, or Firm* — Wolter Van Dyke Davis, PLLC

(57) ABSTRACT

A pilot cone for use in a burner arrangement having a pilot burner includes a casing which widens downstream along a burner axis and has a plurality of cooling air passages passing through it; an inner wall which extends upstream starting from the upstream end of the casing; an annular gap which runs along the inner wall on the radially outer side; and a plurality of cooling air openings which establish a connection between the annular gap and the cooling air passages. Another wall extends upstream at a distance from the inner wall starting from the casing and delimits the annular gap on the radially outer side, the inner wall having a plurality of holes.

23 Claims, 6 Drawing Sheets

(56) References Cited

U.S. PATENT DOCUMENTS

| | | | | |
|---|---|---|---|---|
| 10,451,282 | B2 * | 10/2019 | Benjamin | F23R 3/283 |
| 2003/0000216 | A1 * | 1/2003 | Akagi | F23R 3/04 60/746 |
| 2004/0053181 | A1 | 3/2004 | Pennell | |
| 2004/0146399 | A1 | 7/2004 | Bolms | |
| 2008/0236165 | A1 | 10/2008 | Baudoin | |
| 2010/0180601 | A1 | 7/2010 | Ishiguro | |
| 2015/0300648 | A1 | 10/2015 | Saito | |
| 2016/0305668 | A1 | 10/2016 | Romig | |
| 2017/0292389 | A1 * | 10/2017 | Lörstad | F01D 25/14 |
| 2019/0086088 | A1 | 3/2019 | Stevens | |
| 2020/0025384 | A1 * | 1/2020 | Patel | F23R 3/002 |

FOREIGN PATENT DOCUMENTS

| | | | |
|---|---|---|---|
| EP | 3805642 | A1 | 4/2021 |
| JP | 2004085120 | A | 3/2004 |

* cited by examiner

PILOT CONE COOLING

CROSS REFERENCE TO RELATED APPLICATIONS

This application is the US National Stage of International Application No. PCT/EP2021/054508 filed 24 Feb. 2021, and claims the benefit thereof. The International Application claims the benefit of European Application No. EP20174892 filed 15 May 2020. All of the applications are incorporated by reference herein in their entirety.

FIELD OF INVENTION

The invention relates to a pilot cone for use in a burner arrangement and a burner arrangement. The invention further relates to a method for cooling a pilot cone of a burner arrangement.

BACKGROUND OF INVENTION

It is a widespread measure to provide a central pilot burner with a cone for flame generation. Typically, such a pilot cone is cooled. In this instance, there is generally provision for cooling air to be guided at the rear side of the pilot cone or in cooling channels inside the pilot cone. In this case, it is usual for the cooling air to be directed downstream of the pilot cone into the combustion chamber. This may be considered to be unfavorable with regard to reducing NO, emissions. A closed cooling system with re-use of the cooling air in the pilot burner is necessary for a high-temperature combustion system.

In a closed cooling system, the pilot cone is usually cooled by an integrated design with air which is used as combustion air after the cooling function has been performed. To this end, it is known to provide the pilot cone with large-volume cooling channels which finally guide the cooling air as combustion air to the pilot burner.

However, these designs with internal channels for an air quantity which is substantially greater than is necessary for the cooling function can no longer be considered to be simple. The complex and extremely large structures are neither cost-effective to produce nor do they allow service-life targets to be achieved in a simple manner. Apart from the complexity and costs, the power values are also unsatisfactory.

SUMMARY OF INVENTION

An object of the invention is to provide a pilot cone in which cooling air and scavenging air consumption are as small as possible and which is at the same time as simple and cost-effective as possible to produce. Another object of the invention is to provide a burner arrangement with a pilot cone. Finally, an object of the invention is to provide a corresponding method for operating such a burner arrangement.

The pilot cone of the generic type serves according to provisions to be used in a burner arrangement. In this case, the pilot cone has a conically formed covering which widens downstream along a burner axis. In this case, there is provision for a plurality of cooling air passages, by means of which a cooling of the covering is enabled, to be arranged in the covering. Furthermore, the pilot cone has an internal wall which extends upstream from the upstream end of the covering. In this case, there is provision for an annular gap, through which cooling air can be supplied, to be arranged along the internal covering at the radially external side. A plurality of cooling air openings which produce a connection from the annular gap to the cooling air passages are necessary in the covering adjacent to the annular gap. Consequently, during operation of the burner arrangement, a cooling air guide outside the internal wall through the annular gap and through the cooling air openings and through the cooling air passages is enabled and consequently a cooling of the covering is brought about.

In order to allow optimum adjustment of the cooling air stream in order to ensure the adequate cooling of the covering with a consumption of cooling air which is as small as possible, there is provision according to the invention for an external wall to be arranged at the radially external side with spacing from the internal wall. This wall delimits the annular gap at the radially external side and also extends in this case from the covering upstream. Consequently, a selective cooling air guide to the cooling air openings is opened.

Consequently, an annular gap, via which the air which is supplied to the pilot cone for cooling is distributed according to its use, is formed in the pilot cone by two radially internal and radially external walls which are advantageously coaxial and which extend upstream in a circumferential direction and which are arranged on the covering.

In order now to be able to adjust the cooling air stream optimally, there is further provision for more cooling air to be supplied through the annular gap than the covering will require. The compensation and consequently the optimum adjustment of the cooling air flow in the cooling air passages is enabled by the internal wall being provided with a plurality of apertures. This leads to a division of the air stream which is supplied through the annular gap, on the one hand, to a stream through the apertures and, on the other hand, to a cooling air stream through the cooling air openings into the cooling air passages of the covering.

By using the possible designs which the use of the additive production allows, it is possible to produce a pilot cone with integrated cooling. The pilot cone is therefore a compact component which can be integrated readily into an existing burner and which allows long service-lives. The complexity of the cooling air guide is completely concealed inside the pilot cone and can advantageously be produced with additive production methods. The cooling air throughput is limited to the air throughput which is necessary for the cooling so that more air is available for premixing with the fuel.

In order to optimally adjust the cooling air stream which is intended to be guided through passages, it is particularly advantageous for the total of the cross sectional surface-areas of all the apertures to be greater than the total of the cross sectional surface-areas of all the cooling air openings in the covering of the pilot cone. By selecting the size of the cross sectional surface-areas of the apertures, it is possible to separate the air quantity which is not required for cooling the pilot cone.

It is further advantageous if the cooling air stream which is supplied to the covering can be adjusted by the corresponding dimensioning of the cooling air openings. In this case, it is necessary for the total of the cross sections of the cooling air openings to be smaller than the total of the cross sections of the cooling air passages which extend parallel in technical flow terms.

In another advantageous embodiment, opening cross sections of the respective cooling air openings are smaller than the cross sections of the respective cooling air passages. Consequently, in this embodiment, the apertures which virtually constitute the inlet openings into the cooling air guide in the pilot cone are the smallest passages in the system and can catch particles which could block the subsequent cooling channels. They are considered to be an integrated filter device.

In this case, there is provision in a particularly advantageous manner for the number of cooling air openings to exceed the number of cooling air passages which extend parallel in technical flow terms. Consequently, it becomes possible for the cross section of the individual cooling air openings to be able to be selected to be small in relation to the cross section of the cooling air passages and consequently a blockage of the cooling air passage by particles to be prevented.

In an advantageous embodiment of the invention, an annular distributor, in which the cooling air openings arranged in a circumferential direction open, is arranged in the covering of the pilot cone in order to distribute the cooling air uniformly over the circumference of the pilot cone. Consequently, it is ensured that a somewhat uniform distribution of the cooling air stream over the cooling air passages can also be ensured if individual cooling air openings are blocked. In this case, there is provision for cooling air passages to branch off from the distributor.

The arrangement of the pilot cone in the burner arrangement is advantageously allowed if the pilot cone has a centering collar for receiving a pilot burner. In this case, there is provision for the centering collar to be arranged upstream of the covering radially inside the internal wall. In a particularly advantageous manner, the centering collar in this case forms a cylindrical fitting face.

In order to advantageously fit the pilot burner in the centering collar, there is further advantageously provision for an annular groove to be arranged between the centering collar and the covering. This annular groove is evidently configured to be open toward the burner axis in this case.

This further allows the advantageous arrangement of sealing air outlets in the annular groove. The sealing air outlets form in this case the end of cooling air passages so that the cooling air which is supplied through the cooling air openings flows out through the sealing air outlets. In this instance, these outlets are advantageously distributed equidistantly over the circumference so that a uniform supply with sealing air is produced in the region of the interface of the pilot cone with the pilot burner.

It is further advantageous for the sealing air outlets to be orientated in an inclined manner. On the one hand, a pilot burner stream which is subjected to torsion can thereby be taken into consideration and, on the other hand, an abutment of the stream downstream of the annular groove along the surface of the covering is allowed or consequently a detachment of the stream is prevented.

An advantageous cooling air guide in the covering is achieved if first cooling air passages which extend downstream and second cooling air passages which extend upstream and which are offset in the circumferential direction are used, wherein the first cooling air passages are connected to the second cooling air passages via the first transverse passages at the downstream end of the covering. In this case, there is provision for the cooling air from the cooling air openings to be supplied to the first cooling air passages, wherein the cooling air flows through the second cooling air passages back to the upstream end of the covering after the redirection at the first transverse passages. In the simplest form, the transverse passages extend in the circumferential direction in this case.

If an advantageous distributor is present in the covering, the first cooling air passages begin at the distributor.

If sealing air outlets are present, they are advantageously located at the end of the second cooling air passages.

An advantageous redirection of the cooling air stream at the downstream end of the covering is enabled if a first transverse passage connects at least two first cooling air passages and at least two second cooling air passages to each other. If at least two first cooling air passages open in a first transverse passage and at least two second cooling air passages branch off from the first transverse passage, two advantages result. Firstly, a more uniform temperature distribution can be carried out over the circumference of the pilot cone. Secondly, an entire path does not fail immediately if a cooling air passage is blocked but instead only the throughflow in one direction along a single cooling air passage is disrupted or interrupted while, instead, cooling air can continue to flow adjacent thereto.

In connection with a first transverse passage, two second cooling air passages are advantageously arranged adjacent to each other between two first cooling air passages in this case.

In order also to ensure a cooling air guide in the case of a possible limitation in the throughflow of a first cooling air passage, it is further advantageous in this case for mutually adjacent first cooling air passages which are not connected to each other via a first transverse passage to be connected to each other via second transverse passages.

However, it is particularly advantageous if in the connection via the first transverse passage two first cooling air passages are arranged adjacent to each other between two second cooling air passages.

Similarly, it is further advantageous in order also to ensure a cooling air guide in the case of a possible limitation in the throughflow of a second cooling air passage for mutually adjacent second cooling air passages which are not connected to each other via a first transverse passage to be connected to each other via a second transverse passage.

The arrangement of the second transverse passage is carried out in this case in the direction of the combustion chamber axis in a manner offset upstream relative to the first transverse passage. Consequently, a flow in the second transverse passages is only relevant in cases when a limitation in the throughflow of the connected cooling air passages is provided.

In an advantageous embodiment, the first and second cooling air passages are round in cross section. Although greater channel cross sections can be achieved with rectangular cooling air passages, round cooling air passages are more advantageous with regard to material stresses and service-life.

In order to generally reduce the cooling air requirement, it is advantageous for the internal surface of the covering of the pilot cone, that is to say, the surface at the combustion chamber, to be provided, as generally conventional, with a thermal insulation layer.

The additive production method allows the simple addition of additional features. Therefore, it may be advantageous for at least three projecting tines to be arranged externally on the pilot cone as a catch mechanism. This catch mechanism securely retains the pilot cone in the main burner in the unlikely event of an inadvertent release of the pilot cone.

How the internal wall and—if present—the second wall are configured in specific terms is initially insignificant. The internal wall at least partially surrounds the pilot burner according to provisions in the burner arrangement. To this end, in an embodiment, the internal wall is configured in such a manner that it widens from the covering in an upstream direction. Consequently, a greater structural space for the pilot burner is provided. In this embodiment, the annular gap also necessarily expands from the covering of the pilot cone upstream. According to the spaced-apart arrangement of the second wall—if present—from the first wall, it has a shape which accordingly widens upstream.

The provision of a novel pilot cone allows the production of a new burner arrangement according to the invention. In this case, this arrangement generically initially comprises a centrally arranged pilot burner which extends along a burner axis. At the downstream end of the pilot burner, a pilot cone is arranged in this case. Furthermore, the burner arrangement comprises a main burner which comprises a central opening. The pilot burner is located therein with the pilot cone. In this case, according to the invention the pilot cone has a shape as described above.

Advantageously, a contact location between the pilot burner and the pilot cone is configured as a sliding seat. The term "sliding seat" is intended to be understood in this instance to mean a fit which can readily be joined and which further allows different thermal expansions in the direction of the burner axis.

In this case, it is particularly advantageous for the configuration of the contact location to allow a leak with a slight cooling air stream. Consequently, it is possible to prevent a secure connection from being produced between the pilot cone and the pilot burner at the contact location as a result of excessively high thermal loads and/or as a result of deposits, which connection prevents relative displacement, particularly as a result of different thermal expansions, and can lead to thermal stresses.

It is further advantageous for the present sealing air outlets in the pilot cone, in particular in the annular groove, to be directed toward an end portion of the pilot burner directly downstream of the contact location. Consequently, an optimum protection of the contact location is allowed. The cooling air of the pilot cone is consequently used again after completed cooling of the pilot cone in order to clean at the contact location between the pilot burner and the pilot cone. Otherwise, air would have to be supplied separately to this region.

In this case, it is advantageous for the annular groove to be partially covered in the pilot cone by an end portion of the pilot burner. This allows a protected position of the contact location, in particular of the sliding seat, between the pilot cone and the pilot burner. On the other hand, an annular cavity which promotes the additional cooling air guide is thereby produced. The supplied cooling air is then discharged from a sealing air gap between the upstream end of the covering of the pilot cone and the end portion of the pilot burner.

An advantageous fixing of the pilot cone is provided if the pilot cone is fixed to a pilot cone carrier. The connection is particularly advantageously brought about in this case with respect to the upstream end of the internal wall. In this case, for example, the internal wall can merge seamlessly into the pilot cone carrier.

Furthermore, it is particularly advantageous for the pilot cone carrier to allow the cooling air to be guided at the same time. To this end, a cooling air supply which merges into the annular gap extends radially outside the pilot cone carrier. In a simple and advantageous manner, the pilot cone carrier is in the form of a cylinder.

In order to support the main burner, a main burner carrier is advantageously arranged radially outside the pilot cone carrier. If a cooling air supply is present radially outside the pilot cone carrier, the main burner carrier delimits the cooling air supply at the radially external side.

In this case, it is advantageous for the external wall to be supported on the upstream end thereof on the main burner carrier. In this case, there may be provision for a secure connection/assembly to be carried out or a sliding seat which allows different thermal expansion to be provided.

In order to use the cooling air which is supplied through the annular gap to the pilot cone as combustion air, in an advantageous manner an annular chamber, which is connected to a pilot burner inlet in technical flow terms, is arranged at the side, which is directed toward the burner axis, of the internal wall. As a result, the air quantity supplied for cooling the pilot cone can be divided into a portion which is necessary for cooling the pilot cone with a flow through the cooling air openings and an excess portion with a flow through the apertures, which portion is supplied to the pilot burner for combustion.

The object directed toward a method is achieved by a method for cooling a pilot cone of a burner arrangement with a pilot burner, wherein the pilot cone comprises a covering which widens downstream and which is arranged directly downstream of the pilot burner and is connected thereto in technical flow terms, wherein cooling air is guided inside the covering and cooling air which leaves the covering cleans an interface between the pilot burner and the pilot cone.

Advantageously, cooling air is supplied in the covering of the pilot cone via a first cooling air passage and is guided back via a second cooling air passage which is adjacent to the first cooling air passage. First and second cooling air passages are connected to each other near the downstream end of the pilot burner via comparatively short first transverse passages. In particular, the cooling air is guided over the shortest path from the annular distributor at the upstream end as far as the vicinity of the downstream end of the pilot cone and from there guided back over the shortest path. An efficient cooling or temperature distribution which is as uniform as possible is thereby produced in the pilot cone.

It is further advantageous for cooling air to be guided back in the case of a blocked second cooling air passage via a second cooling air passage which is adjacent to the blocked second cooling air passage.

The significant advantages of the invention are particularly a compact pilot cone without any impediments to expansion with a uniform component temperature and resultant high component service-life.

Furthermore, a closed air cooling of the pilot cone can be achieved with cleaning of the interface between the pilot cone and the pilot burner, wherein the cooling air which is already used to cool the covering of the pilot cone is again used. In this instance, it is particularly advantageous for cooling air which is discharged at the contact location between the pilot cone and the pilot burner to be able to be used subsequently and additionally as combustion air.

Another advantage is the improved non-sensitivity to cooling air openings becoming blocked or individual cooling air passages becoming blocked and an advantageous cooling of the covering of the pilot cone being ensured without any decrease.

The complex, internal channel structure is advantageously promoted by using additive production. Therefore, the component can be constructed very efficiently with regard to cooling power and cooling air balance. An additional advantage of the additive production involves the very short production times.

BRIEF DESCRIPTION OF THE DRAWINGS

The invention is explained in greater detail by way of example with reference to the drawings. In the drawings, in a schematic manner and not to scale.

DETAILED DESCRIPTION OF INVENTION

Figure 1:
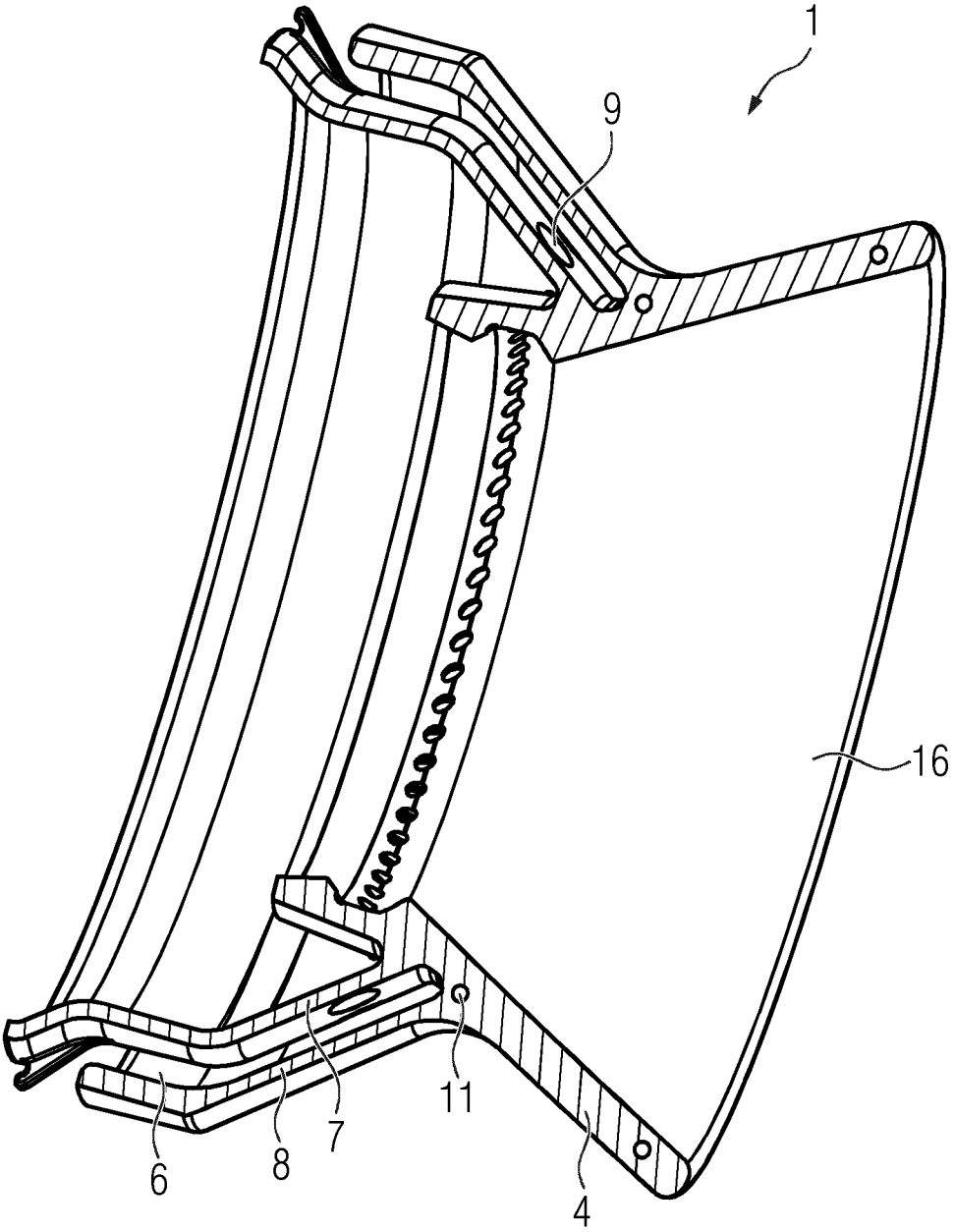
FIG. 1 shows a perspective view of a pilot cone as a longitudinal section.

FIG. 1 illustrates a perspective view of an exemplary embodiment for a pilot cone 1 according to the invention as a longitudinal section. The pilot cone 1 has a covering 4 which widens downstream in a main flow direction of the fuel and air. The indication "upstream" always relates to the side opposite a combustion chamber which follows the pilot cone while the term "downstream" always relates to the side directed toward the combustion chamber.

An internal surface 16 of the covering 4 of the pilot cone 1 is provided with a thermal insulation layer. Inside the covering 4, a cooling air guide 5 extends (not visible in this view).

An internal wall 7, which wall 7 also widens in this case, extends upstream from the upstream-directed end of the covering 4. With spacing from the internal wall 7, the external wall 8 is located at the radially external side. In this case, an annular gap 6 which is used for guiding cooling air is formed between the internal wall 7 and the external wall 8.

Figure 2:
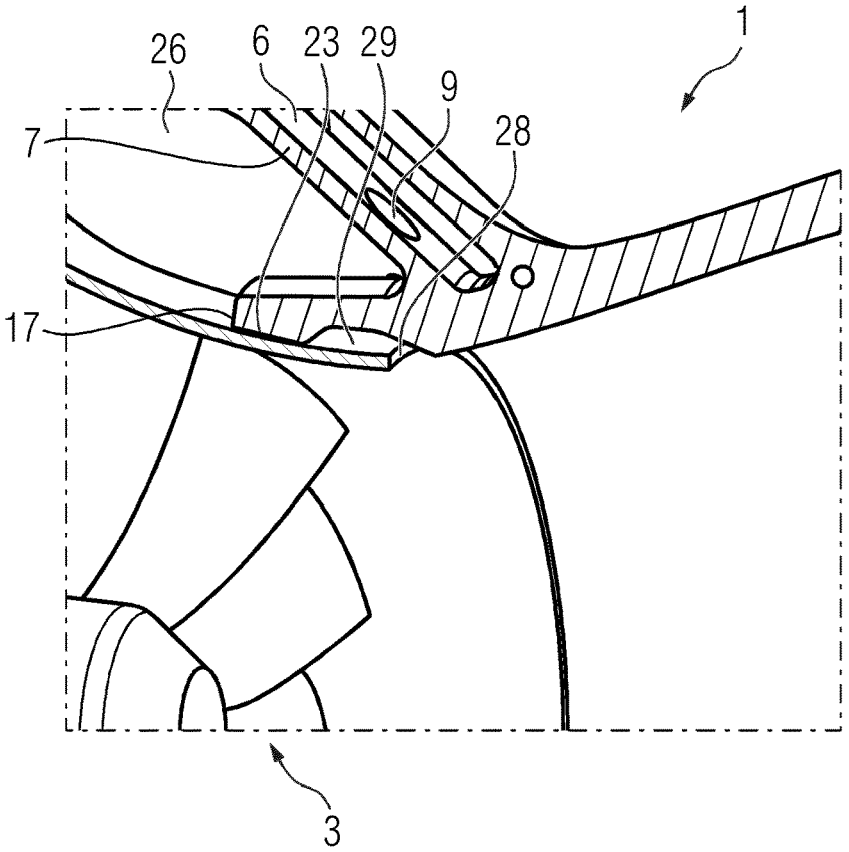
FIG. 2 shows a cutout of the pilot cone from FIG. 1 with the pilot burner arranged therein.

FIG. 2 indicates a cutout of a burner arrangement with the pilot cone 1 and a pilot burner 3 which is arranged therein. An annular chamber 26 is located at the side directed toward the burner axis 21 in a manner adjacent to the internal wall 7 and radially outside the pilot burner 3.

A significant aspect for the invention is the division of the cooling air supplied through the annular gap 6, on the one hand, in order to cool the covering 4 and, on the other hand, to mix with the combustion air which is supplied to the pilot burner 3. To this end, the internal wall 7 has a plurality of apertures 9 which are distributed over the circumference and which produce a connection between the annular gap 6 and the annular chamber 26. The cooling air guide from the annular gap 6 into the covering 4 of the pilot cone 1 can be seen in FIG. 6 and is explained in greater detail below.

It is further possible to see a centering collar 17 at the upstream end of the covering 4, in which collar 17 the pilot burner 3 is supported in a contact location 23 with a sliding seat. In this case, the contact location 23 allows a relative displacement of the pilot burner 3 relative to the pilot cone 1 and consequently prevents thermal stresses. Furthermore, the contact location 23 between the pilot burner 3 and the pilot cone 1 acting as sliding seats allows a leak of the cooling air from the annular chamber 26 and consequently acts counter to sticking of the two components 1, 3 in the contact location 23 against each other.

An annular groove 30 is located between the contact location 23 and the covering 4 of the pilot cone. This groove is partially covered at the radially internal side by an end portion of the pilot burner 3. A circumferential cavity 29 is thereby formed. A sealing air gap 28 is located between the end portion of the pilot burner 3 and the upstream end of the covering 4 of the pilot cone 1.

Figure 3:
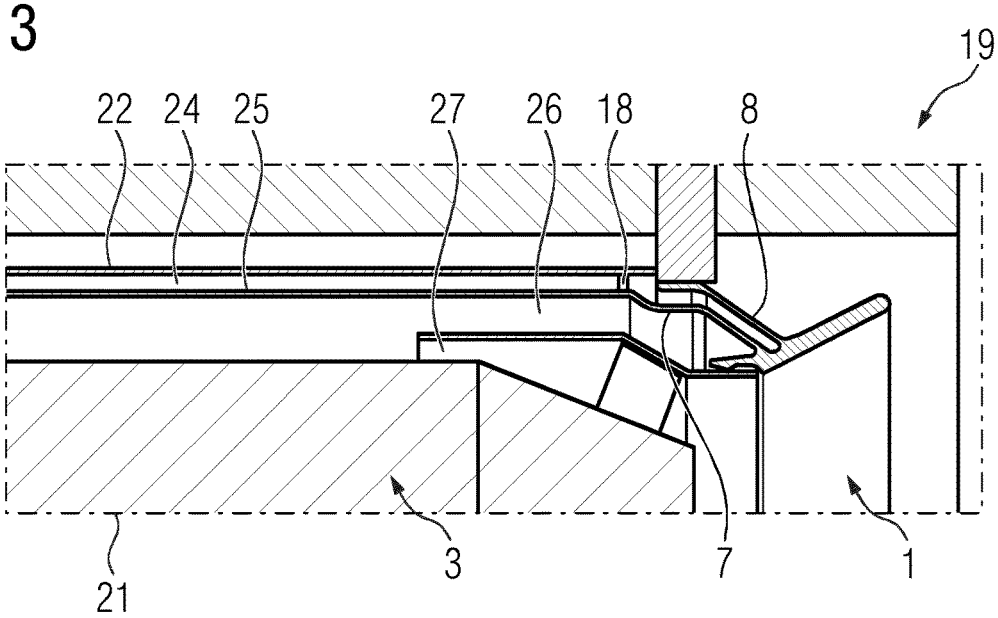
FIG. 3 shows a cutout of a burner arrangement with the pilot cone from FIG. 1 and a pilot burner and, in portions, a main burner.

FIG. 3 schematically shows by way of example a cutout of a burner arrangement 2 with a central burner axis 21, comprising a main burner 19 and a pilot burner 3 which is arranged in the main burner 19. In this instance, the pilot cone 1 is arranged directly downstream of the pilot burner 3.

In this instance, the main burner 19 is supported at the radially inner side via a main burner carrier 22. At the same time, there is provision in this embodiment for the external wall 8 of the pilot cone 1 to be supported in the main burner carrier 22 at the upstream end 8 thereof and consequently for a centering to be carried out.

A pilot cone carrier 25 is located with spacing from the main burner carrier 22 at the side directed toward the burner axis 21. The internal wall 7 of the pilot cone 1 adjoins the end of the pilot cone carrier 25. On this internal wall 7, in this embodiment a plurality of projecting tines 18 are arranged at the outer side in a state distributed over the circumference. The tines 18 prevent displacement out of the main burner 19 if the pilot cone 1 becomes released.

In this embodiment, the main burner carrier 22 and the pilot cone carrier 25 are configured in a cylindrical manner and arranged coaxially relative to each other and bring about a separation in technical flow terms. A cooling air supply 24 is thereby formed between the main burner carrier 22 and the pilot cone carrier 25. The cooling air which flows through the cooling air supply 24 further brings about a cooling of the main burner carrier 22.

The cooling air supply 24 is optimized in order to generate the flow speed necessary for the thermal transmission with a low pressure loss at the same time. The high pressure drop between the cooling air inlet and outlet of the pilot cone 1 allows an efficient cooling with a comparatively low air mass flow.

The external cooling air supply 24 opens in the annular gap 6 of the pilot cone 1, which annular gap 6 is formed by the two upstream-inclined, coaxial, radially internal and radially external walls 7, 8 which are arranged on the covering 4. The radially internal wall 7 is connected to the pilot cone carrier 25 and the radially external wall 8 is connected to the main burner carrier 22 so that a closed cooling air guide to the pilot cone 1 is formed between the main burner 19 and the pilot burner 3.

From the annular gap 06, the cooling air flows partially through the apertures 9 in the internal wall 7 into the annular chamber 26 and subsequently to the main flow path of the combustion air which is supplied to the pilot burner to a pilot burner inlet 27.

The cooling air guide 5 in the covering 4 of the pilot cone 1 is explained in greater detail with reference to FIGS. 4 to 9—see, in particular, FIG. 7. The cooling air guide 5 has a pattern which repeats over the circumference so that the structure in the covering 4 of the pilot cone 1 can evidently be inferred from FIGS. 4 to 6, 8 and 9.

Figure 5:
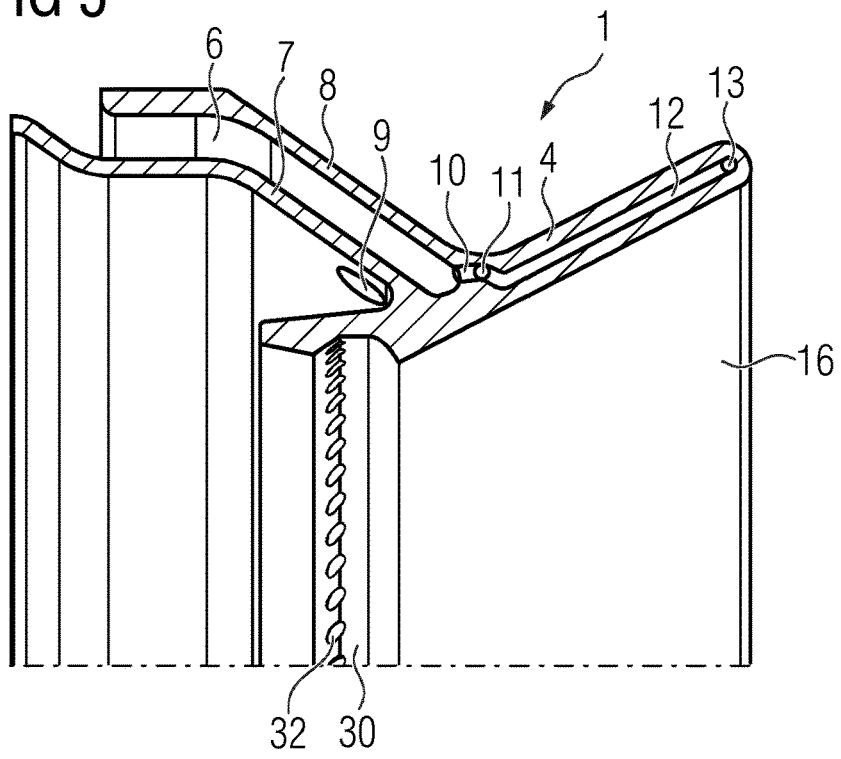
FIG. 5 again shows the pilot cone from FIG. 1 with a section though the first cooling air passages.
Figure 6:
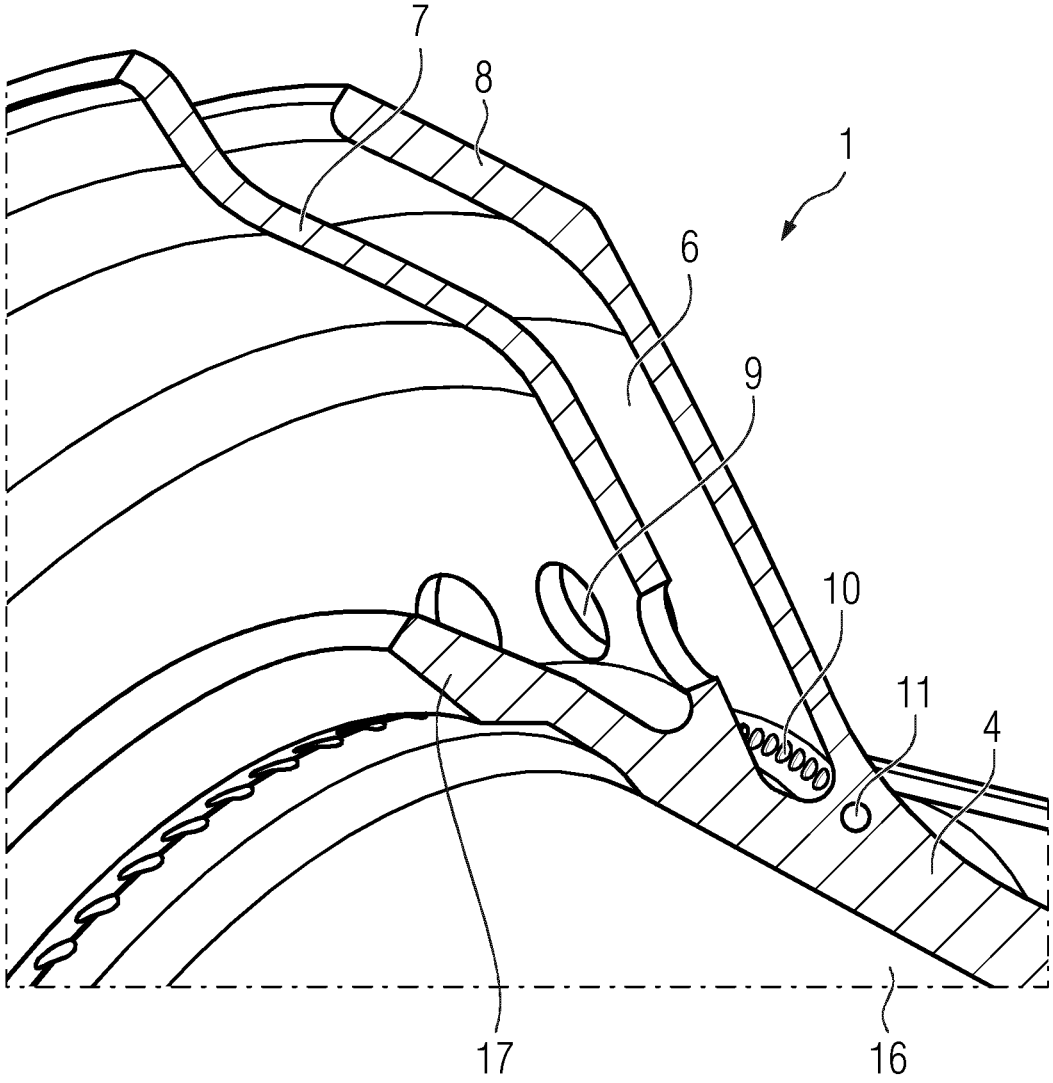
FIG. 6 shows another detailed view of the pilot cone in the region of the cooling air openings and the cooling air apertures.
Figure 7:
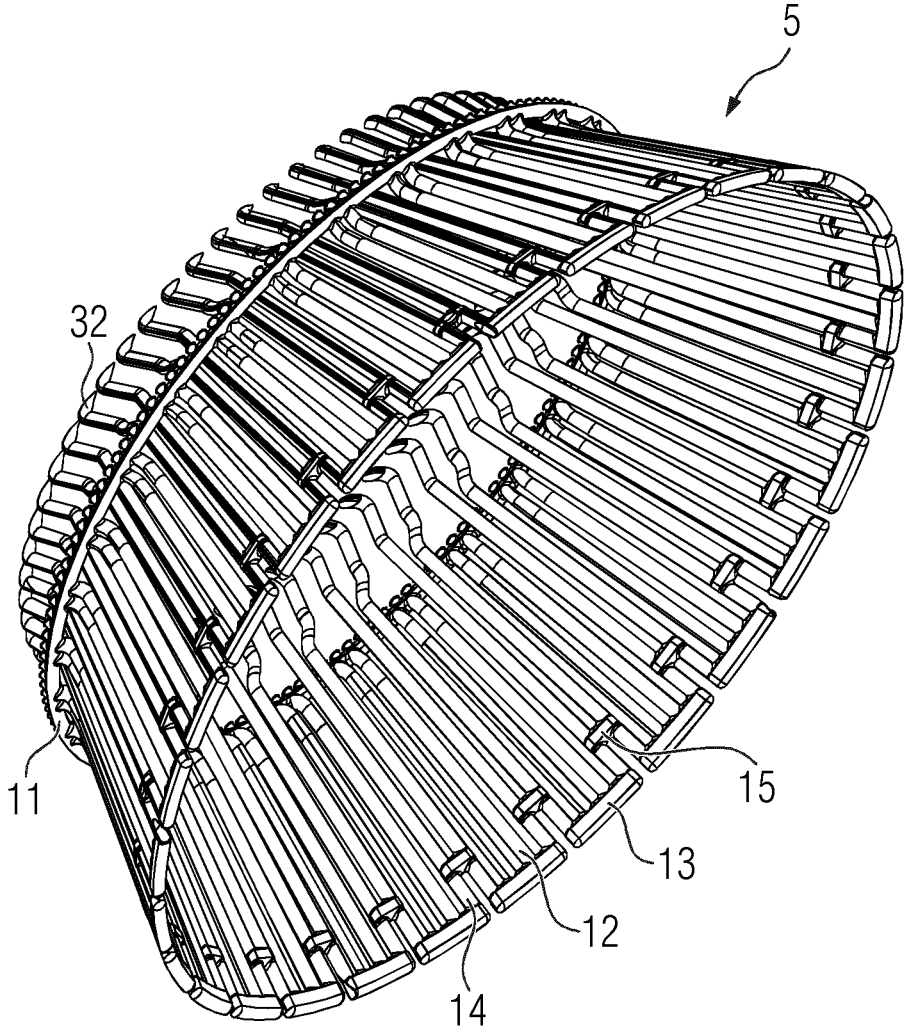
FIG. 7 shows the cooling air guide in the covering of the pilot cone.

In a state distributed over the circumference, a plurality of cooling air openings 10 are located near the upstream end of the covering 4, see FIGS. 5 and 6, and produce a connection from the annular gap 6 to the cooling air passages 12, 14 in the covering 4. An annular distributor 11 is arranged in the covering 4 of the pilot cone 1, in which annular distributor 11 the cooling air openings 10 which are arranged in the circumferential direction open. During operation of the burner arrangement 2, the air for cooling the pilot cone 1 therefore flows initially through a large number of cooling air openings 10, which are arranged in a manner distributed in a circumferential direction, into the mentioned annular distributor 11.

Figure 8:
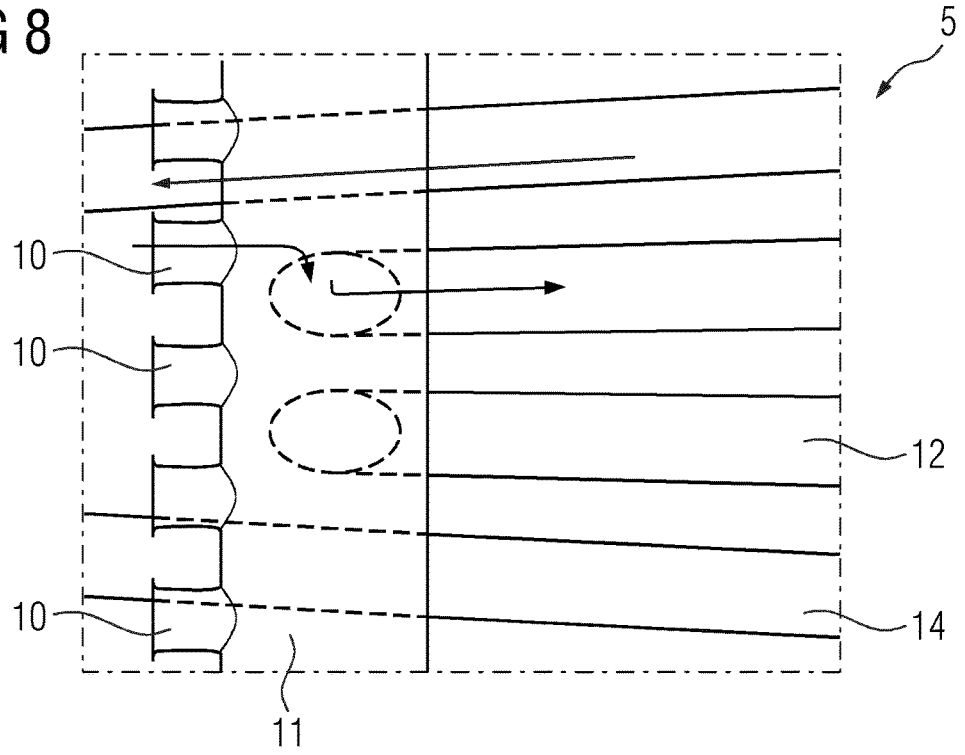
FIG. 8 schematically shows the cooling air guide in the covering from the cooling air openings.

First cooling air passages 12 branch off from the distributor 11 and extend inside the covering 4 substantially downstream, see FIG. 5 and FIG. 8.

Figure 9:
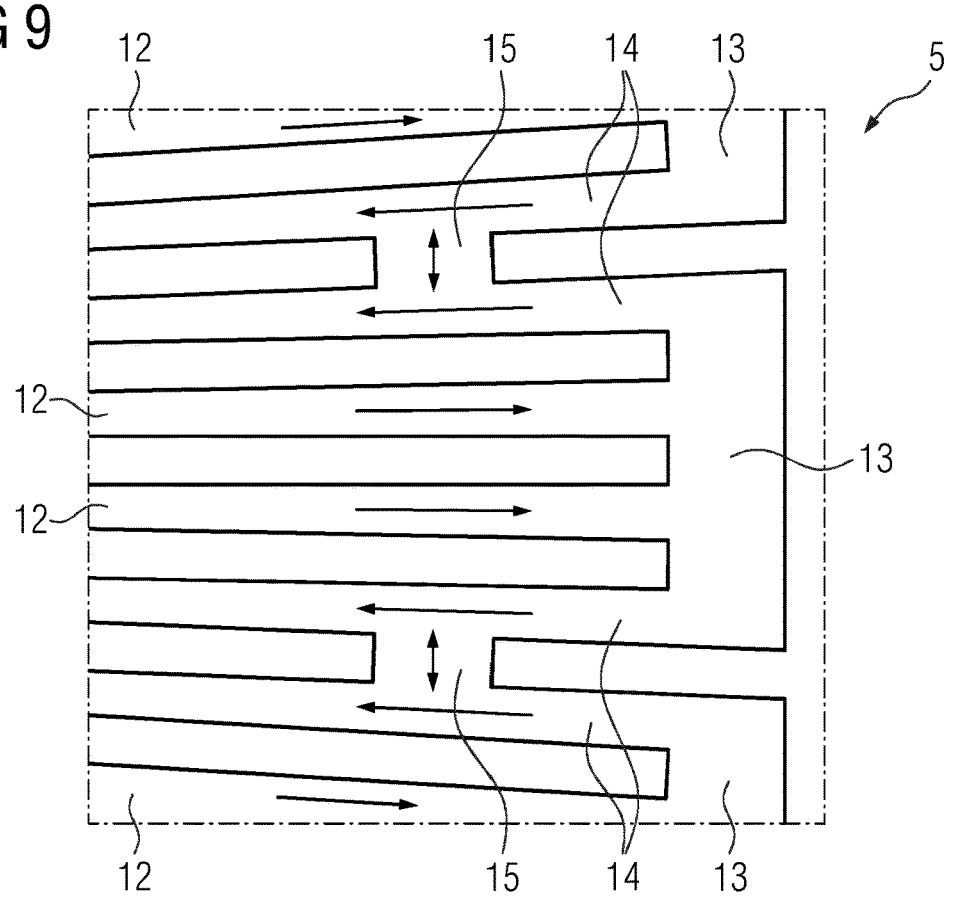
FIG. 9 schematically shows the cooling air guide in the region of the transverse passages.

At the downstream end of the covering 4, the first cooling air passages 12 each open into first transverse passages 13 which extend in a circumferential direction, see FIG. 9. Second cooling air passages 14 which extend upstream again branch off from the first transverse passages 13, see FIG. 4. In this embodiment, there is provision for two adjacent first cooling air passages 12 to open in a first transverse passage 13 and two second cooling air passages 14 to branch off from the first transverse passage 13.

The first and second cooling air passages 12, 14 are round in cross section as a configuration which is advantageous and simplest.

Therefore, the air flows through the first cooling air passages 12 to the front edge of the pilot cone 1 and flows at that location over first transverse passages 13 to respective adjacent second cooling air passages 14 which are provided for guiding back the air to the interface with the pilot burner 3.

The first and second cooling air passages 12, 14, that is to say, the channels which supply and guide back, are arranged alternately and adjacent second cooling air passages 14 are connected by second transverse passages 15 in order to allow a cooling air flow, even though it may be reduced, through non-blocked portions in the unlikely event of a blocked cooling passage.

After damage with blocked cooling passages 12, 14, this emergency cooling property is intended to act counter to further damage to the pilot cone 1 so that a somewhat uniform cooling can also be ensured if a single cooling air passage 12, 14 is blocked.

The cross sections of the cooling air openings 10 are selected to be smaller than the cross sections of the first and second cooling air passages 12, 14 or the first and second transverse passages 13, 15 so that a filter function at the inlet to the cooling air guide 5 is produced.

Figure 4:
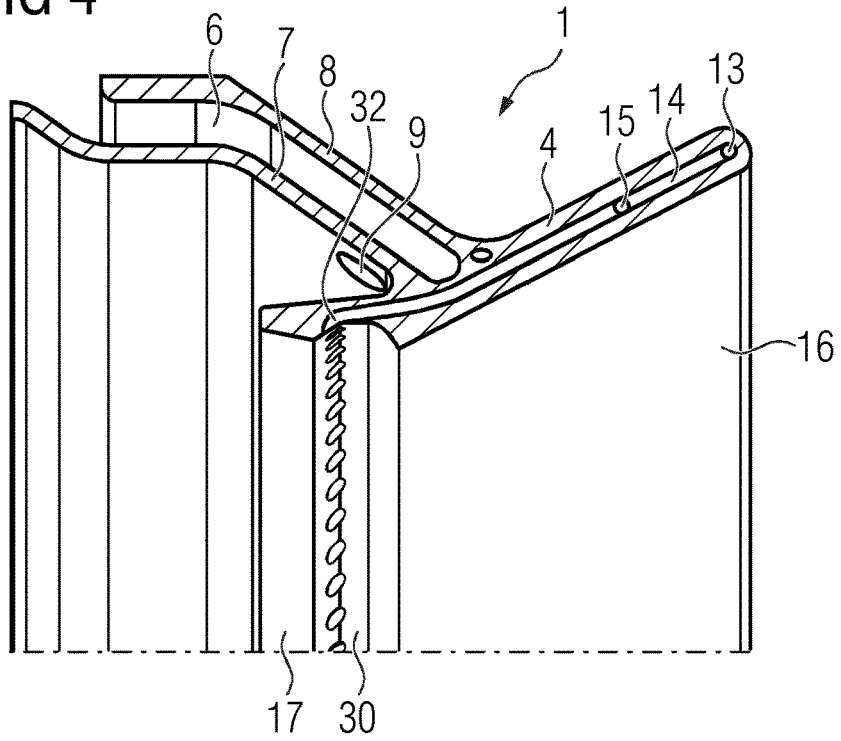
FIG. 4 again shows the pilot cone from FIG. 1 with a section through the second cooling air passages.

The second cooling air passages 14 open in the annular groove 30 or in the circumferential cavity 29 at the contact location 23 of the pilot cone 1 with the pilot burner 3, see FIG. 4 (also FIG. 2). That is to say, after flowing through the pilot cone 1, the cooling air is introduced into a circumferential cavity 29 which blocks the interface between the pilot cone 1 and the pilot burner 3 to prevent the introduction of hot gas. Subsequently, the cooling air is mixed with the pilot burner flow.

The passages, which are near the outlet and which are referred to as sealing air outlets 32, of the second cooling air passages 14 are arranged in the annular groove 30 in an equidistant manner over the circumference and orientated in such a manner that they are inclined during operation of the burner arrangement 2 in the direction of a torsion-affected pilot burner flow in order to bring about abutment of the flow downstream of the annular groove 30 along the covering 4 or to prevent detachment. The sealing air outlets 32 are protected as a side effect of the overlap.

The cleaning of the sealing air gap 28, as is necessary from safety aspects, at the contact location 23 between the pilot cone 1 and the pilot burner 3 is connected with re-use of the cooling air. Consequently, the cooling is considered to be closed or neutral in terms of cooling air. As a result of the high pressure drop between the cooling air inlet and outlet, a high cooling effect is obtained with a small cooling air mass flow.

The invention claimed is:

1. A pilot cone for use in a burner arrangement, comprising:

a covering which widens downstream along a burner axis and which is passed through by cooling air passages, and having an internal wall which extends upstream from an upstream end of the covering, an annular gap which extends at the radially external side along the internal wall and comprising cooling air openings which produce a connection from the annular gap to the cooling air passages, and an external wall which extends upstream with spacing from the internal wall from the covering and which delimits the annular gap at the radially external side, wherein the internal wall comprises apertures, and wherein the internal wall and the annular gap widen upstream.

2. The pilot cone as claimed in claim 1, wherein a total of the cross sectional surface-areas of all the apertures is greater than a total of the cross sectional surface-areas of all the cooling air openings.

3. The pilot cone as claimed in claim 1, wherein a total of the cross sectional surface-areas of all the cooling air openings is smaller than a total of the cross sectional surface-areas of all the cooling air passages; and/or wherein the cross sectional surface-area of each individual cooling air opening is smaller than the cross sectional surface-area of the cooling air passages.

4. The pilot cone as claimed in claim 1, wherein an annular distributor which is connected to the cooling air openings and to first cooling air passages is arranged in the covering, wherein the first cooling air passages branch off from the annular distributor.

5. The pilot cone as claimed in claim 1, wherein a centering collar is arranged upstream of the covering in order to receive a pilot burner.

6. The pilot cone as claimed in claim 5, wherein a circumferential annular groove, which is open toward the burner axis, is arranged between the covering and the centering collar.

7. The pilot cone as claimed in claim 6, wherein sealing air outlets are arranged in connection with second cooling air passages in the circumferential annular groove, wherein the sealing air outlets are inclined so that a cooling air flow which is partially tangential occurs; and/or wherein the sealing air outlets form an end of the second cooling air passages.

8. The pilot cone as claimed in claim 1, wherein first cooling air passages extend inside the covering downstream and second cooling air passages extend upstream, wherein adjacent first and second cooling air passages are connected to each other via first transverse passages.

9. The pilot cone as claimed in claim 8, wherein at least two first cooling air passages and at least two second cooling air passages are connected to each other via a first transverse passage; or wherein two adjacent first cooling air passages and two second cooling air passages are connected to each other via a first transverse passage; or wherein two adjacent second cooling air passages and two first cooling air passages are connected to each other via a first transverse passage.

10. The pilot cone as claimed in claim 9, wherein mutually adjacent second cooling air passages which are not connected via the first transverse passages are connected to each other via second transverse passages which are offset upstream relative to the first transverse passages.

11. A burner arrangement, comprising:

a burner axis comprising a main burner and a pilot burner which is arranged centrally therein and a pilot cone as claimed in claim 1 which is arranged at a downstream end of the pilot burner.

12. The burner arrangement as claimed in claim 11, wherein a contact location between the pilot burner and the pilot cone is in the form of a sliding seat.

13. The burner arrangement as claimed in claim 12, wherein an annular groove is covered at least partially by an end portion of the pilot burner and a circumferential cavity is formed.

14. The burner arrangement as claimed in claim 12, wherein the contact location is between the pilot burner and a centering collar, wherein the contact location allows a small cooling air flow.

15. The burner arrangement as claimed in claim 11, wherein the pilot cone is fixed to a pilot cone carrier.

16. The burner arrangement as claimed in claim 15, wherein a main burner carrier is arranged radially outside the pilot cone carrier.

17. The burner arrangement as claimed in claim 16, wherein the main burner carrier is arranged radially outside a cooling air supply, wherein the external wall is supported on the main burner carrier.

18. The burner arrangement as claimed in claim 15, wherein the internal wall is fixed to the pilot cone carrier, and wherein a cooling air supply extends radially outside the pilot cone carrier and merges into the annular gap.

19. The burner arrangement as claimed in claim 11, wherein the apertures lead to an annular chamber which is connected to a pilot burner inlet of the pilot burner in technical flow terms.

20. The pilot cone as claimed in claim 1, wherein the internal wall and the annular gap and the external wall widen upstream.

21. A pilot cone for use in a burner arrangement, comprising:

a covering which widens downstream along a burner axis and which is passed through by cooling air passages, and having an internal wall which extends upstream from an upstream end of the covering;

an annular gap which extends at the radially external side along the internal wall and comprising cooling air openings which produce a connection from the annular gap to the cooling air passages; and an external wall which extends upstream with spacing from the internal wall from the covering and which delimits the annular gap at the radially external side;

wherein the internal wall comprises apertures;

wherein a total of the cross sectional surface-areas of all the cooling air openings is smaller than a total of the cross sectional surface-areas of all the cooling air passages; and/or wherein the cross sectional surface-area of each individual cooling air opening is smaller than the cross sectional surface-area of the cooling air passages.

22. A pilot cone for use in a burner arrangement, comprising:

a covering which widens downstream along a burner axis and which is passed through by cooling air passages, and having an internal wall which extends upstream from an upstream end of the covering;

an annular gap which extends at the radially external side along the internal wall and comprising cooling air openings which produce a connection from the annular gap to the cooling air passages; and an external wall which extends upstream with spacing from the internal wall from the covering and which delimits the annular gap at the radially external side;

wherein the internal wall comprises apertures; and wherein an annular distributor which is connected to the cooling air openings and to first cooling air passages is arranged in the covering, wherein the first cooling air passages branch off from the annular distributor.

23. A pilot cone for use in a burner arrangement, comprising:

a covering which widens downstream along a burner axis and which is passed through by cooling air passages, and having an internal wall which extends upstream from an upstream end of the covering;

an annular gap which extends at the radially external side along the internal wall and comprising cooling air openings which produce a connection from the annular gap to the cooling air passages; and an external wall which extends upstream with spacing from the internal wall from the covering and which delimits the annular gap at the radially external side;

wherein the internal wall comprises apertures;

wherein a centering collar is arranged upstream of the covering in order to receive a pilot burner; and wherein a circumferential annular groove, which is open toward the burner axis, is arranged between the covering and the centering collar.

* * * * *